US005655977A

United States Patent [19]

Kakiuchi et al.

[11] Patent Number: 5,655,977

[45] Date of Patent: Aug. 12, 1997

[54] WOUND GOLF BALL

[75] Inventors: Shinichi Kakiuchi; Takashi Maruko; Junji Hayashi, all of Yokohama, Japan

[73] Assignee: Bridgestone Sports Co., Ltd., Tokyo, Japan

[21] Appl. No.: 408,289

[22] Filed: Mar. 22, 1995

[30] Foreign Application Priority Data

Mar. 29, 1994 [JP] Japan ..... 6-082358
May 17, 1994 [JP] Japan ..... 6-126923

[51] Int. Cl.[6] ..... A63B 37/08

[52] U.S. Cl. ..... 473/354; 473/357

[58] Field of Search ..... 273/231; 473/354, 473/357

[56] References Cited

U.S. PATENT DOCUMENTS 5,511,791 4/1996 Ebisuno et al. ..... 473/354

FOREIGN PATENT DOCUMENTS 816243 4/1937 France ..... 273/231
453091 9/1936 United Kingdom ..... 273/231

*Primary Examiner*—George J. Marlo
*Attorney, Agent, or Firm*—Sughrue, Mion, Zinn, Macpeak & Seas

[57] ABSTRACT

A wound golf ball including a liquid center (4) in the form of a rubber bag (2) filled with a liquid (3), a thread rubber layer (5), and a cover (6). The filling liquid of the liquid center is a liquid having water-insoluble powder dispersed therein so as to have a specific gravity in the range of 1.08–1.70 and a viscosity in the range 1–6,000 centipoise at 23° C. The water-insoluble fine particles are present in the range of 4–60% by weight of the liquid dispersion. By improving the filling liquid, the wound golf ball is increased in flying distance while maintaining its own controllability.

13 Claims, 1 Drawing Sheet

WOUND GOLF BALL

BACKGROUND OF THE INVENTION

1. Field of the Invention

This invention relates to a thread wound golf ball affording an increased flying distance while maintaining its inherent controllability.

2. Prior Art

Many professional golfers favor thread wound golf balls of the liquid center type wherein a liquid center in the form of a rubber bag filled with a liquid is covered by closely and tightly winding thread rubber thereon and further enclosed in a cover because they are receptive to spin, easy to control and respond with a pleasant feel upon hitting.

Because of the increased spin, the wound golf balls fly less distance compared with two-piece golf balls. Various proposals have been made for solving the problem of flying distance. Particularly in connection with wound golf balls of the liquid center type, it is known that the liquid center plays the role of adjusting the entire ball weight and largely dictates the initial speed, spin and feel on hitting. Therefore, attempts were made to modify the liquid center in order to reduce spin as disclosed in JP-A 168471/1985, 181070/1987 and 255162/1990.

However, the lowering of spin tends to detract from the controllability inherent to wound golf balls. It is thus desired to have a wound golf ball which is improved in flying distance without detracting from controllability.

SUMMARY OF THE INVENTION

Therefore, an object of the present invention is to provide a wound golf ball which is improved in flying distance while maintaining spin receptivity and controllability, In efforts to improve the flying distance and controllability of wound golf balls of the liquid center type, inventors paid attention to the liquid filled in the liquid center. We have found that by adjusting the specific gravity and viscosity of the liquid by blending fine powder therein, more particularly by adjusting the specific gravity to 1.08 or more and the viscosity to 10,000 centipoise or less, the flying distance of a wound golf ball can be increased while maintaining spin receptivity and without detracting from controllability.

The present invention is directed to a thread wound golf ball comprising a liquid center in the form of a rubber bag filled with a liquid, a thread rubber layer, and a cover. According to the invention, the liquid of the liquid center is a dispersion of water-insoluble fine particles in a liquid. The liquid dispersion has a specific gravity of at least 1.08 to 23° C. and a viscosity of up to 10,000 centipoise at 23° C.

BRIEF DESCRIPTION OF THE DRAWINGS

The sole FIGURE.

DETAILED DESCRIPTION OF THE INVENTION

Figure 1:
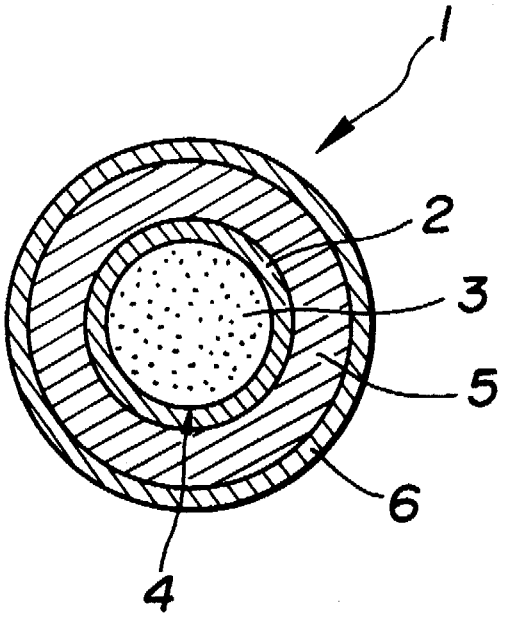
FIG. 1 is a cross-sectional view of one exemplary wound golf ball according to the present invention.

Referring to FIG. 1, a thread wound golf ball 1 includes a liquid center 4 in the form of a rubber sphere or bag 2 filled with a liquid 3, a thread rubber layer 5, and a cover 6. The liquid 3 contained in the liquid center 4 is a liquid having water-insoluble fine particles dispersed therein. The liquid dispersion has a specific gravity of at least 1.08 and a viscosity of up to 10,000 centipoise at 23° C.

The liquid contained in the liquid center is typically water.

The fine powder dispersed in the filling liquid may be of any desired material which is insoluble in water and available in the form of fine particles, for example, those materials commonly used as fillers, such as barium sulfate, zinc white and silica. The particles should preferably have a mean particle size of 0.02 to 100 μm, more preferably 0.5 to 20 μm. The amount of fine particles blended is preferably about 4 to 60% by weight, more preferably about 10 to 50% by weight of the entire filling liquid or liquid dispersion.

The filling liquid in the liquid center should have a specific gravity of at least 1.08, preferably 1.08 to 2.00, more preferably 1.09 to 1.70 at 23° C. With a specific gravity of less than 1.08, the resulting ball does not follow a low trajectory or fly a long distance even when the filling liquid has a viscosity within the scope of the invention. Any desired specific gravity can be achieved by properly adjusting the amount of fine powder blended.

The filling liquid in the liquid center should also have a viscosity of up to 10,000 centipoise, preferably 1 to 8,000 centipoise, more preferably 1 to 6,000 centipoise at 23° C. With a viscosity in excess of 10,000 centipoise, the resulting ball does not follow a low trajectory regardless of the specific gravity of the liquid. The viscosity may be adjusted by adding a suitable amount of a thickener. Examples of the thickener used herein include sodium carboxymethyl cellulose, methyl cellulose, acrylates, and casein.

It is to be noted that the specific gravity is a measurement at 23° C. The viscosity is measured at 23° C. by using a viscometer model DVL-BII manufactured by Toki Sangyo K. K. and rotating a spindle SB No. 5 at 12 rpm (shear rate 2.58 $s^{-1}$).

In the wound golf ball according to the invention, the liquid of its liquid center may have a surfactant and other additives blended therein. Exemplary surfactants are dodecyl-benzene sulfonic acid and sodium dodecylbenzene sulfonate.

A rubber bag or center bag is filled with the above-mentioned liquid to form a liquid center. Any conventional rubber bag may be used. The liquid center should preferably have a diameter of 26 to 32 mm, especially 28 to 30 mm.

Thread rubber of a conventional type is wound on the liquid center by a conventional technique. The wound liquid center is then enclosed in a cover by a conventional technique. The cover may be formed of a conventional cover material, typically an ionomer resin. The cover preferably has a radial thickness of 1.0 to 2.5 mm, especially 1.2 to 1.8 mm.

The wound golf ball thus completed should have a diameter and weight complying with the golf rules, namely a diameter of at least 42.67 mm and a weight of up to 45.92 g.

EXAMPLE

Examples of the present invention are given below by way of illustration and not by way of limitation. All parts are by weight.

Examples 1–3 & Comparative Examples 1–5

A barium sulfate paste was prepared according to the composition shown in Table 1.

TABLE 1

| Paste | A | B | C |
|---|---|---|---|
| Barium sulfate | 100 | 100 | 100 |
| Thickener* | 6 | 12 | 18 |
| Surfactant** | 4 | 4 | 4 |
| Water | 30 | 30 | 30 |

*sodium carboxymethyl cellulose
**dodecylbenzene sulfonic acid

A center bag was prepared by molding a rubber composition as shown in Table 2 in a semi-spherical mold to form a semi-spherical half-shell having an outer diameter of 28 mm. Center bags A and B shown in Table 2 had a hollow space volume of 7.1 and 6.4 $cm^3$, respectively.

TABLE 2

| Center bag | A | B |
|---|---|---|
| Composition | | |
| Natural rubber | 100 | 100 |
| Stearic acid | 1 | 1 |
| Zinc white | 330 | 350 |
| Processing oil | 30 | 30 |
| Vulcanization accelerator | 1.5 | 1.5 |
| Sulfur | 2.5 | 2.5 |
| Physical properties as vulcanized | | |
| Hardness, JIS A scale | 61 | 62 |
| Specific gravity | 2.23 | 2.37 |
| Bag gage (mm) | 2.2 | 2.3 |

A liquid center was prepared by applying an adhesive to the circular edges of a pair of half-shells, charging the half-shells with the paste and water in amounts as shown in Table 3, and mating the half-shells together in water, followed by vulcanization. The viscosity of the liquid (filling liquid) reported in Table 3 was measured at 23° C. by using a viscometer model DVL-BII manufactured by Toki Sangyo K. K. and rotating a spindle SB No. 5 at 12 rpm (shear rate 2.58 $s^{-1}$).

Thread rubber was wound on each of the liquid centers by a conventional thread winding technique to form a thread rubber layer having a radial thickness of about 6 mm. By a compression molding technique, an ionomer resin mixture of Himilan 1557 and Himilan 1856 in a weight ratio of 50/50 was molded over the wound liquid center to form a cover thereon. The cover had a radial thickness of about 1.4 mm and a hardness of 84 on JIS C scale.

The wound golf balls thus obtained were examined for various properties. The results are shown in Table 4.

TABLE 3

| Liquid center | A | B* | C* | D* | E | F | G* | H* |
|---|---|---|---|---|---|---|---|---|
| Center bag | A | A | A | A | A | A | A | B |
| Liquid components | | | | | | | | |
| Paste | A | B | C | A | A | A | A | — |
| Paste amount (g) | 2.0 | 2.0 | 2.0 | 0.5 | 1.0 | 2.5 | 3.0 | — |
| Water amount (g) | 6.2 | 6.2 | 6.2 | 6.9 | 6.7 | 6.0 | 5.8 | 6.4 |
| Liquid specific gravity | 1.16 | 1.15 | 1.14 | 1.05 | 1.09 | 1.20 | 1.25 | 1.00 |
| Liquid viscosity (cp) | 1400 | 14700 | 33300 | 10 | 60 | 5400 | 13900 | 1 |
| Liquid center outer diameter (mm) | 28.0 | 28.0 | 28.0 | 28.0 | 28.0 | 28.0 | 28.0 | 28.0 |
| Liquid center weight (g) | 18.0 | 17.9 | 17.9 | 17.1 | 17.4 | 18.2 | 18.4 | 17.7 |
| | Example | Comparative Example | Comparative Example | Comparative Example | Example | Example | Comparative Example | Comparative Example |

*outside the scope of the invention

TABLE 4

| | Example | | | Comparative Example | | | | |
|---|---|---|---|---|---|---|---|---|
| | 1 | 2 | 3 | 1 | 2 | 3 | 4 | 5 |
| Liquid center | A | E | F | B | C | D | G | H |
| Liquid specific gravity | 1.16 | 1.09 | 1.20 | 1.15 | 1.14 | 1.05 | 1.25 | 1.00 |
| Liquid viscosity (cp) | 1400 | 60 | 5400 | 14700 | 33300 | 10 | 13900 | 1 |
| Ball weight (g) | 45.4 | 44.9 | 45.6 | 45.4 | 45.3 | 44.6 | 45.9 | 45.2 |
| Ball outer diameter (mm) | 45.68 | 45.68 | 42.69 | 42.68 | 42.69 | 42.67 | 42.67 | 42.68 |
| Ball hardness 1) (mm) | 2.86 | 2.85 | 2.87 | 2.90 | 2.88 | 2.89 | 2.88 | 2.84 |
| Ball properties | | | | | | | | |
| Spin (rpm) | 3120 | 3140 | 3140 | 3130 | 3110 | 3140 | 3120 | 3300 |
| Initial speed (rpm) | 65.4 | 65.5 | 65.3 | 65.4 | 65.3 | 65.5 | 65.3 | 65.3 |
| Launch angle (°) | 10.2 | 10.2 | 10.2 | 10.2 | 10.2 | 10.3 | 10.2 | 10.3 |
| Elevation angle (°) | 12.1 | 11.9 | 12.0 | 12.5 | 12.4 | 12.5 | 12.4 | 12.7 |
| Carry (m) | 208.0 | 207.6 | 208.3 | 209.5 | 209.0 | 209.4 | 209.3 | 210.2 |
| Total 2) (m) | 225.6 | 226.2 | 225.0 | 223.8 | 223.2 | 223.5 | 223.4 | 221.3 |

1) ball hardness: a distortion of a ball under a load of 100 kg

2) Using a hitting machine manufactured by True Temper Company, a ball was hit by a driver at a head speed of 45 m/s. The results is an average of 12 tests for each Example.

It is evident from Table 4 that as compared with the golf ball wherein only water is used as the filling liquid (Comparative Example 5), the golf balls within the scope of the invention (Examples 1–3) show a slightly reduced spin, a substantially equal initial speed and launch angle, and an improved total flying distance. The golf balls wherein the filling liquid is outside the scope of the invention (Comparative Examples 1–4) show a slightly reduced spin and a reduced total flying distance, failing to achieve the objects of the invention.

There has been described a wound golf ball wherein by improving the filling liquid of the liquid center, the flying distance is increased while maintaining the controllability inherent to the wound golf ball.

Japanese Patent Application Nos. 6-126923 and 6-82358 are incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising;

a liquid center in the form of a rubber bag filled with a liquid, said liquid of the liquid center being a liquid dispersion of water-insoluble fine particles having a specific gravity in the range of 1.08 to 1.70 and a viscosity of up to 10,000 centipoise at 23° C., a thread rubber layer enclosing the liquid center, and a cover enclosing the thread rubber layer.

2. The wound golf ball of claim 1 wherein the liquid is water and the water-insoluble fine particles is blended in an amount of about 4 to 60% by weight in the liquid center.

3. The wound golf ball of claim 1 wherein said liquid center has a diameter in the range of 26–32 mm.

4. The wound golf ball of claim 1 wherein said water-insoluble fine particles have a mean particle size in the range of 0.02 to 100 μm.

5. The wound golf ball of claim 1 wherein said water-insoluble fine particles are blended to 4–60% by weight of said liquid dispersion.

6. The wound golf ball of claim 1 wherein said fine particles are selected from the group consisting of barium sulfate, zinc white and silica.

7. The wound golf ball of claim 1 wherein said liquid has a viscosity in the range of 1 to 6,000 centipoise at 23° C.

8. The golf ball of claim 7 wherein said liquid includes a thickener.

9. A wound golf ball comprising;

a liquid center in the form of a rubber bag filled with a liquid, said liquid of the liquid center being a liquid dispersion of water-insoluble fine particles having a specific gravity in the range of 1.08 to 1.70 and a viscosity of 1 to 6,000 centipoises at 23° C., said water-insoluble fine particles being present in the range of about 4 to 21.0% by weight in said liquid dispersion, a thread rubber layer enclosing the liquid center, and a cover enclosing the thread rubber layer.

10. The wound golf ball of claim 9 wherein said liquid center has a diameter in the range of 26–32 mm.

11. The wound golf ball of claim 9 wherein said water-insoluble fine particles have a mean particle size in the range of 0.02 to 100 μm.

12. The wound golf ball of claim 9 wherein said fine particles are selected from the group consisting of barium sulfate, zinc white and silica.

13. The golf ball of claim 9 wherein said liquid includes a thickener.

* * * * *